United States Patent [19]

Engel

[11] Patent Number: 4,751,894

[45] Date of Patent: Jun. 21, 1988

[54] ADVERTISING DEVICE AND A DEVELOPING DEVICE THEREFOR

[76] Inventor: Peter Engel, 100 Sea Beach Ave., Stamford, Conn. 06902-8126

[21] Appl. No.: 893,353

[22] Filed: Aug. 5, 1986

[51] Int. Cl.[4] ..... B05C 1/02

[52] U.S. Cl. ..... 118/242; 118/243; 118/248; 118/260

[58] Field of Search ..... 283/97; 118/242, 243, 118/244, 260, 248

[56] References Cited

U.S. PATENT DOCUMENTS

| | | | |
|---|---|---|---|
| 1,594,678 | 8/1926 | Ludlow | 118/242 |
| 2,485,737 | 10/1949 | Jacoby, Jr. | 118/242 |
| 3,139,689 | 7/1964 | Quintel et al. | 283/97 X |

*Primary Examiner*—John P. McIntosh
*Attorney, Agent, or Firm*—Arthur T. Fattibene

[57] ABSTRACT

An advertising device formed of sheet material having a first and second portion, one of which includes a predetermined visual indicia formed thereon, and the other portion having a non-visible or latent image or indicia formed thereon; whereby the latter is rendered visible by coating the latent image with a developing ink. This disclosure further contemplates a developing device for developing the latent or non-visible image or indicia, which includes a support arranged to receive the sheet of material so that the portion having non-visible or latent image is predeterminedly positioned at a developing station formed on the support adjacent to a source of a developing ink supply formed thereon. A carriage containing a roller is slidably supported on the support, whereby the reciprocation of the carriage relative to the support causes the roller to transfer the developing ink from the supply source to the sheet so as to coat the portion containing the non-visible or latent image or indicia to render the same visible.

7 Claims, 2 Drawing Sheets

ADVERTISING DEVICE AND A DEVELOPING DEVICE THEREFOR

FIELD OF INVENTION

This invention is directed to a novel advertising device for enhancing the sales of one's goods and/or services, and to a developer for rendering the advertising device effective.

PRIOR ART

Various advertising devices are known for enhancing the sale of goods and/or services. Such advertising devices generally include the use of circular and/or flyers to advertise a good or service. Frequently, coupons are associated with such flyers or circulars which can be redeemed by a consumer for a premium and/or a discount toward the purchase of a particular good and/or service to which the coupon is directed. Heretofore, such coupons bore visible indicia, whereby the consumer was always informed as to the particular premium and/or discount associated with such coupon. For this reason, a prospective consumer would immediately accept or reject the coupon, depending upon the consumer's immediate need or desire for the particular good or premium to which a given coupon was directed. As such coupons were always directed to a known quantity, they contained no surprise and frequently presented little, if any, interest to the vast majority of prospective consumers. Such conventionally known coupon advertising devices, therefore, had limited appeal and/or effectiveness in promoting one's goods and/or services.

OBJECTS

An object of this invention is to provide an advertising device for enhancing the sale of various goods and/or services that is specifically constructed so as to increase a consumer's appeal for the goods and/or services to which the advertising device is directed.

Another object is to provide an advertising device which is constructed so as to arouse a consumer's curiosity, and thereby utilizing a consumer's curiosity for directing attention to a particular good and/or service.

Another object is to provide an advertising device and a machine for use therewith so as to render the advertising device effective.

Another object is to provide a novel advertising device which is relatively simple in construction, inexpensive to produce and which is effective in operation.

SUMMARY OF THE INVENTION

The foregoing objects and other features and advantages are attained by an advertising device in the form of a flyer, circular or coupon having a first portion provided with visible indicia, which is rendered redeemable for a predetermined item, and a second portion which is provided with a non-visible indicia which is rendered redeemable for an unknown quantity, and which unknown quantity is ascertainable only when a developing fluid or ink is coated over the non-visible indicia to render the non-visible indicia visible. In accordance with this invention, the non-visible indicia is rendered visible by a developing device which includes a base or support having a developing station, upon which the portion of the flyer, circular or coupon containing the non-visible indicia is predeterminately positioned. Adjacent to the developing station, there is provided a source for containing a supply of the developing fluid or ink. Slidably mounted on the base or support is a carriage having a roller mounted therein which is disposed in rolling engagement with the supply source and the developing station so that by effecting the reciprocation of the carriage and roller relative to the base or support, the roller will effect the transfer of the developing ink or fluid from the supply source to the developing station, and thus coating of the portion containing the non-visible indicia. The arrangement is such that the coating of the non-visible indicia with the ink or fluid will render the non-visible indicia immediately visible.

FEATURES

A feature of this invention relates to an advertising device that icludes a readily separable coupon portion which includes a visible indicia which is redeemable for a known quantity ad a non-visible portion which is redeemable for an unknown quantity until developed.

Another feature of this invention resides in the provision of an advertising device which is constructed so as to appeal to the curiosity of a consumer.

Another feature of this invention is directed to an advertising device in the form of a flyer or circular having at least a pair of readily separable coupon portions, one of which is redeemable for a known quantity, and the other redeemable for an unknown quantity, until developed.

Another feature of this invention resides in the provision of a developing device which is constructed to effect the development of the non-visible portion of the advertising device.

Another feature of the invention resides in the provision of a relatively simple developing device which is simple and positive in operation.

Other features and advantages will become more readily apparent when considered in view of the drawings and description thereof in which.

DETAIL DESCRIPTION

Figure 2:
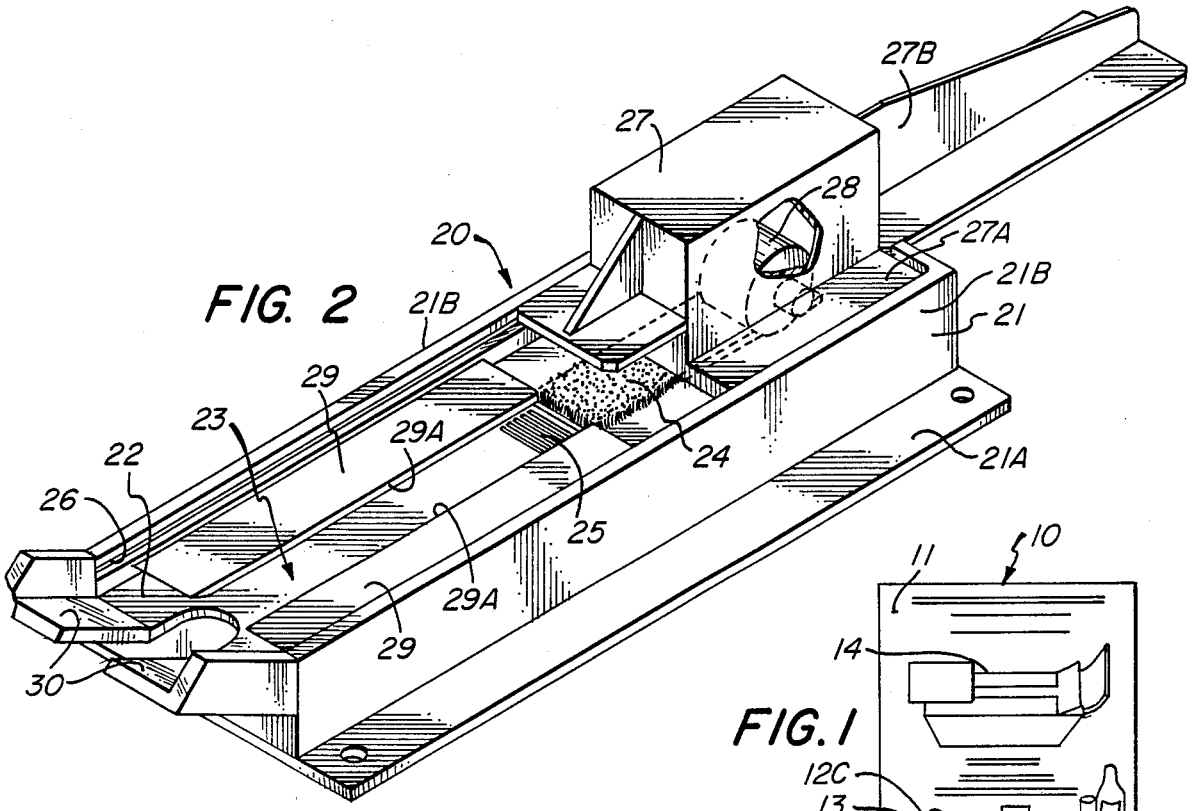
FIG. 2 is a perspective view of a developing device for use with the advertising device of FIG. 1.
Figure 1:
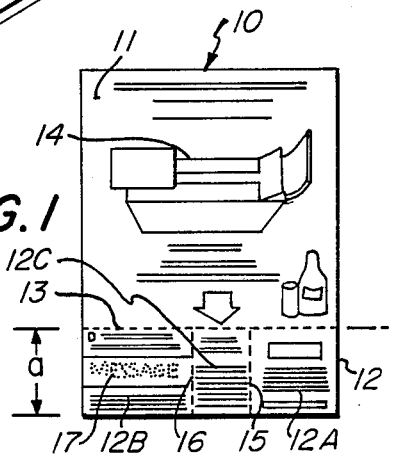
FIG. 1 is a plan view of an advertising device embodying the present invention.
Figure 3:
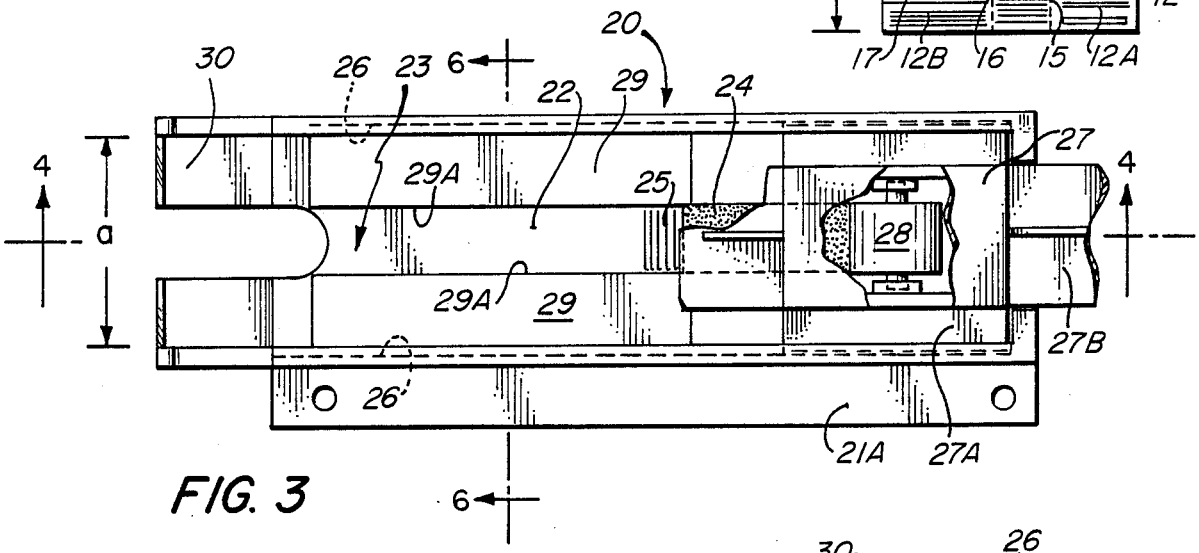
FIG. 3 is a top plan view of the developing device of FIG. 2.

Referring to FIG. 1, there is shown therein an advertising device 10 embodying the present invention. The advertising device 10 is illustrated in the form of a circular or flyer having a first portion 11 and a second portion 12, wherein the latter portion 12 is readily separated from the first portion 11 by a frangible or tear line 13. It will be understood that the first portion 11 may be provided with suitable indicia means 14 in the form of copy pertaining to a particular goods or service to which the advertising device 10 is directed.

The second portion 12 includes a first coupon portion 12A and a second coupon portion 12B; disposed to either side of a validation portion 12C.

Portion 12 is provided with a pair of spaced apart transversely extending tear lines 15 and 16, by which the respective coupon portions 12A and 12B may be readily separated from the validation portion 12C of the flyer or circular 10. The respective tear lines 15 and 16 extend between tear line 13 and the outer peripheral edge of the circular or flyer 10.

In accordance with this invention, coupon portion 12A is provided with a visible indicia means to indicate for what particular goods or services the coupon portion 12A may be redeemed by a consumer. Coupon portion 12B is provided with a non-visible indicia means 17, which may likewise be redeemable for a particular good or service. However, since the indicia means 17 is normally not visible, a consumer cannot ascertain for what particular goods or service the coupon portion 12 can be redeemed.

Such non-visible indicia means 17 can be formed on coupon portion 12B by any one of several known chemical formulations that may be used as an invisible printing ink, e.g. of the kind suggested or disclosed in U.S. Pat. No. 3,826,499. Preferably, the non-visible indicia means 17 is disposed along the central portion of the coupon portion 12B, as shown in FIG. 1. The non-visible indicia means 17 on coupon portion 12B thus provides a "mystery" redeemable value which will arouse a consumer's curiosity.

In accordance with this invention, a developing device 20 is provided, whereby a consumer may ascertain the value of the mystery coupon portion 12B. Such developing device 20 would be located at the place where the coupon portions 12A and/or 12B can be redeemed. The developing device 20 comprises a base or support 21, which can be suitably placed on a countertop or other accessible location. The base 21 may be provided with a laterally extending flange 21A, whereby it can be secured to a countertop or the like. Mounted on the base 21 is a top supporting surface 22 which defines a developing station 23 disposed adjacent one end thereof. Disposed adjacent to the developing station 23 and adjacent the other end of the supporting surface is a reservoir or supply means in the form of a pad 24, saturated with a supply of developing fluid. Between the supply source or pad 24 and the adjacent developing station 23, the top surface is provided with a plurality of transversely spaced ribs 25 to define a roughened portion.

Figure 6:
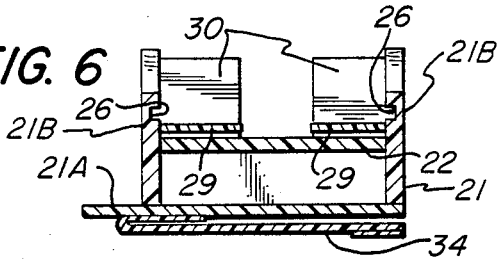
FIG. 6 is a sectional view taken along line 6—6 on FIG. 3.
Figure 4:
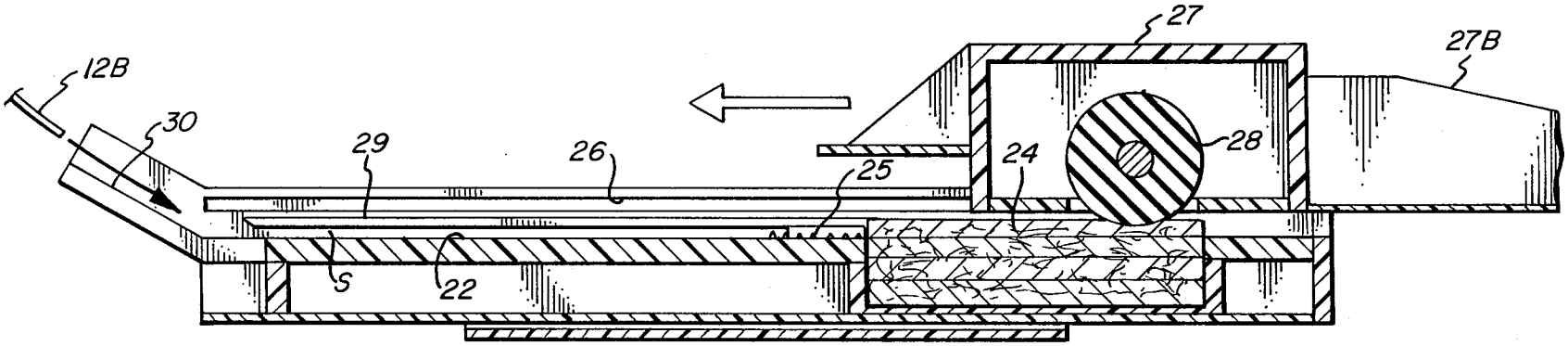
FIG. 4 is a sectional view taken along line 4—4 on FIG. 3.
Figure 5:
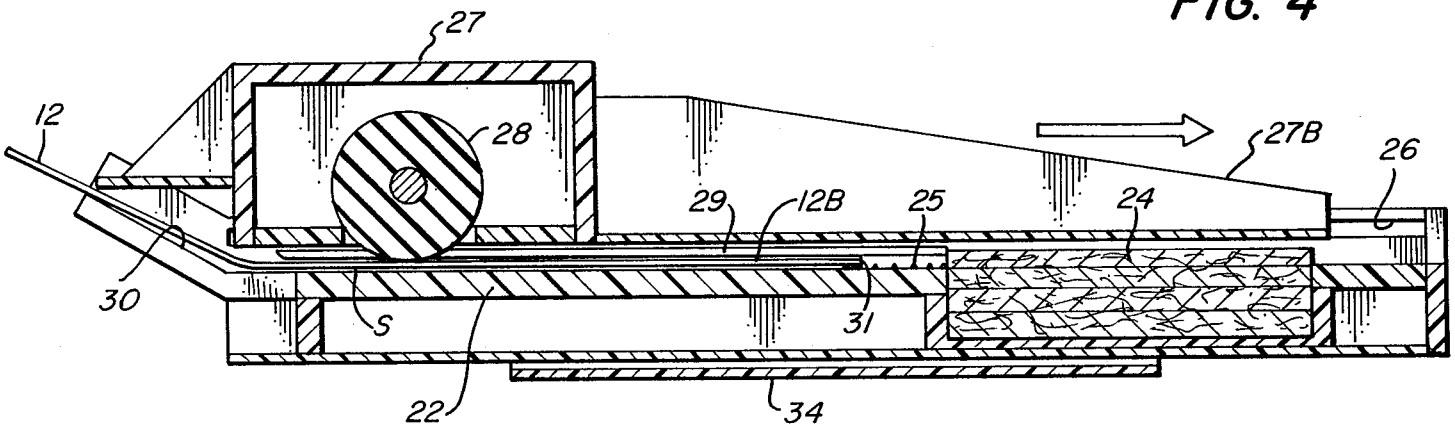
FIG. 5 is a sectional view similar to that of FIG. 4, but showing the parts in a developing position.

As shown in FIGS. 1 and 6, the side walls 21B, 21B extend above the top surface 22. Formed on the inner surface of the respective side wall extensions is a groove 26 to define a track way. A carriage 27 having laterally extending flanges 27A is slidably mounted on the trackway, whereby the carriage can be reciprocally moved therealong. Rotatably journalled in the carriage 27 is a roller 28. The arrangement is such that the carriage 27 and the roller 28 journalled therein can be shifted back and forth between the ends of the base or top surface. An actuating handle 27B may be connected to one end of the carriage to facilitate the manipulation thereof. Connected to the respective side walls 21B, 21B and spaced slightly above the top of the supporting surface 22 are a pair of opposed guide plates 29, 29. The respective guide plates 29, 29 are disposed essentially parallel to the top surface 22 and slightly spaced thereabove. The inner edges 29A, 29A of the respective guide plates 29 are spaced to define a path along which the roller 28 may be guided as the carriage is reciprocated along its track means. Connected to the inlet end of the developing device is an incline plane or slide 30. The arrangement is such that the inlet defined by the incline 30 is disposed in communication with the spacings between the top supporting surface 22 and the guide plates 29, 29. With the construction described, it will be apparent that the coupon portion 12 containing coupon portion 12B can be readily inserted into the developing device 20 by guiding the coupon portion 12B into the inlet 30, whereby the coupon portion 12B can be readily received in the space S defined between the top surface 22 and the guide plates 29,29. An end stop 31 is provided to limit the insertion of the coupon portion 12 into the space S of the developing device; as best seen in FIG. 5. With the coupon portion 12 inserted into the developing device 20 as described, it will be noted that the portion of coupon 12B containing the non-visible or latent image 17 thereon will be disposed between the inner edges 29A, 29A of the respective guide plates 29, 29 and in the roll way defined thereby. Thus, by effecting the displacement of the carriage 27 and roller 28 back and forth along its tracks, the developing fluid or ink picked up by the roller 28 as it rolls over the supply pad is transferred onto the coupon portion 17 disposed in the rollway so as to coat the coupon portion 17 containing the non-visible image or message; thereby developing or causing the non-visible image or message to be rendered visible. Accordingly, the consumer, at his or her option, can then redeem the coupon 12B for the value and/or premium specified by the developed image.

The roughened area defined by the ribs 25 between the supply pad 24 and the developing station 23 are arranged to engage the roller 28 to assure that the roller will roll and not slide along the top surface in effecting the development of the coupon portion 17.

If desired, a mounting clip 34 may be secured to the underside of the base 21 to provide an alternate means by which the developing device may be secured to a supporting surface.

From the foregoing description, it will be apparent that an enhanced advertising device in the form of a flyer or circular is provided, which includes a coupon portion directed to arouse the curiosity of the consumer in a manner whereby the consumer is required to take the coupon portion to the point of sale in order to ascertain its value. Also, the value is ascertained in a readily simple manner simply by placing the coupon portion into the slideway of a developing device and traversing the carriage and associated developing roller across the face portion of the coupon 12B, whereby the face of the coupon is coated with a compatible developing fluid to render the latent image on the coupon visible.

While the present invention has been described with respect to a particular embodiment thereof, it will be readily appreciated and understood that variations and modifications may be made without departing from the spirit or scope of the invention.

What is claimed is:

1. A developing device for rendering non-visible indicia comprising a base, means defining a track mounted on said base, a carriage mounted on said track means for movement therealong, a roller means rotatably journalled on said carriage, a developing station means on said base, means containing a supply of a suitable developer disposed adjacent said developing station means, said roller means being in rolling engagement with said developing station and supply means, positioning means disposed at said developing station for locating the non-visible indicia thereat, said carriage means and roller means being reciprocally mounted on said track means for serially transversing over said developing station and said supply means, whereby said roller means transfer developer from said supply means to said non-visible indicia at said developing station to render said non-visible indicia visible, said base includes a top surface to define a support for said indicia at said developing station, and said positioning means including a pair of spaced apart guides, said guides being slightly spaced above the top surface of said base to define an indicia track for receiving and guiding an indicia inserted between said guides and said top surface, and means to limit the insertion of said indicia in said indicia track between said guide and said top surface.

2. A developing device as defined in claim 1, wherein said supply means comprises a pad saturated with a developer, said supply means being disposed in alignment with said developing station, whereby said roller is guided in rolling engagement between said stations as said carriage traverses over said track.

3. A developing device for rendering visible non-visible indicia comprising a base, means defining a track mounted on said base, a carriage mounted on said track means for movement therealong, a roller means rotatably journalled on said carriage, a developing station means on said base, means containing a supply of a suitable developer disposed adjacent said developing station means, said roller means being in rolling engagement with said developing station and supply means, positioning means disposed at said developing station for locating the non-visible indicia thereat, said carriage means and roller means being reciprocally mounted on said track means for serially transversing over said developing station and said supply means, whereby said roller means transfer developer from said supply means to said non-visible indicia at said developing station to render said non-visible indicia visible, an inlet means for directing the non-visible indicia to said developing station, wherein said inlet means includes an incline slide for directing the indicia to said positioning means.

4. A developing device for rendering visible pre-printed non-visible indicia comprising a base having a top supporting surface defining a developing station and a developer supply station, a pair of spaced apart track means mounted on said base to extend along said developing station and developer supply station, said spaced apart track means being disposed above the top supporting surface, a carriage means mounted on said track means for movement therealong, said carriage means including a housing slidably mounted on said track means, a roller rotatably mounted in said carriage housing, said roller being disposed in rolling engagement with said top surface at said developing station and developer supply station, positioning means at said developing station, said positioning means including a pair of spaced apart guide plates to define a roller way for said roller at said developing station, said guide plates being slightly spaced from said supporting surface to define an indicia track for receiving therebetween the pre-printed non-visible indicia, said developer supply station including a resilient pad saturated with a supply of developer, said pad being disposed in alignment with the roller way defined by said guide plates, an inclined inlet disposed in communication with said indicia track, and an actuator connected to said carriage housing for facilitating the shifting of said carriage housing and associated roller along said track means.

5. A developing device as defined in claim 4, and including a plurality of ribs extending transversely of said roller way, said ribs being disposed between said developer supply station and said developer station.

6. A developing device as defined in claim 4 and including a mounting means connected to said base.

7. A developing device as defined in claim 6 wherein said mounting means includes dip plate resiliently hinged to the undersurface of said base.

* * * * *